US009004488B2

(12) United States Patent
Terashima

(10) Patent No.: US 9,004,488 B2
(45) Date of Patent: Apr. 14, 2015

(54) CONVEYING APPARATUS AND IMAGE FORMING APPARATUS

(75) Inventor: Hideyuki Terashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 13/567,358

(22) Filed: Aug. 6, 2012

(65) Prior Publication Data

US 2013/0043646 A1 Feb. 21, 2013

(30) Foreign Application Priority Data

Aug. 19, 2011 (JP) ..... 2011-179607

(51) Int. Cl.

| | |
|---|---|
| ***B65H 5/02*** | (2006.01) |
| ***B65H 5/04*** | (2006.01) |
| ***B65H 3/06*** | (2006.01) |
| ***B65H 5/06*** | (2006.01) |
| ***B65H 9/00*** | (2006.01) |

(52) U.S. Cl.

CPC ..... *B65H 3/0684* (2013.01); *B65H 5/062* (2013.01); *B65H 9/006* (2013.01); *B65H 9/008* (2013.01); *B65H 2404/1521* (2013.01); *B65H 2403/72* (2013.01); *B65H 2404/6111* (2013.01)

(58) Field of Classification Search

USPC ..... 271/273, 274, 226, 242–245

See application file for complete search history.

(56) References Cited

U.S. PATENT DOCUMENTS

| | | | | |
|---|---|---|---|---|
| 5,673,911 | A * | 10/1997 | Loftus et al. | 271/273 |
| 7,077,517 | B2 | 7/2006 | Awai et al. | |
| 7,445,208 | B2 * | 11/2008 | Onodera | 271/239 |
| 7,533,878 | B2 | 5/2009 | Cook et al. | |
| 7,641,184 | B2 | 1/2010 | Terashima et al. | |
| 7,798,491 | B2 * | 9/2010 | Moteki et al. | 271/242 |
| 8,079,589 | B2 | 12/2011 | Kinoshita et al. | |
| 8,393,618 | B2 * | 3/2013 | Nakada et al. | 271/227 |
| 8,419,013 | B2 * | 4/2013 | Muneyasu et al. | 271/246 |
| 8,430,400 | B2 * | 4/2013 | Lewalski et al. | 271/225 |
| 8,434,759 | B2 * | 5/2013 | Abe et al. | 271/243 |

FOREIGN PATENT DOCUMENTS

JP H02-18244 A 1/1990

* cited by examiner

*Primary Examiner* — Prasad Gokhale

(74) *Attorney, Agent, or Firm* — Fitzpatrick, Cella, Harper & Scinto

(57) ABSTRACT

A conveying apparatus includes a first pair of rollers having a drive roller and a pinch roller driven by the drive roller, a second pair of rollers provided downstream of the first pair of rollers, and an arm member supporting the drive roller and adapted to be swingable such that a force for pressing the drive roller against the pinch roller increases as a conveyance resistance of the sheet increases. The force for pressing the drive roller against the pinch roller decreases if driven by the moving sheet. The conveying speed of the second pair of rollers is set to be higher than the conveying speed of the drive roller so as to cause the drive roller to be driven by the sheet in the case where a skew of the sheet has been corrected and the sheet having the skew corrected is conveyed by the second pair of rollers.

13 Claims, 19 Drawing Sheets

CONVEYING APPARATUS AND IMAGE FORMING APPARATUS

BACKGROUND OF THE INVENTION

1. Field of the Invention

The present invention relates to a conveying apparatus, which conveys a sheet, and an image forming apparatus provided with the conveying apparatus.

2. Description of the Related Art

An image forming apparatus, such as a printer, a copying machine or a facsimile, usually has a conveying apparatus adapted to take out one sheet material at a time from a stack of a plurality of sheet materials and convey the sheet. The conveying apparatus has a conveying roller, which is rotatively driven by a drive source, and a pinch roller, which is disposed such that it opposes the conveying roller and which follows the rotation of the conveying roller. The conveying apparatus conveys a sheet material by rotating the conveying roller, with the sheet material sandwiched between the conveying roller and the pinch roller.

Some of the conveying apparatuses include skew correcting mechanisms for correcting the skew of a sheet material relative to the conveying direction of the sheet material. The skew of the sheet material relative to the conveying direction can be corrected by abutting the leading end of the sheet material against a resist roller or a resist shutter. The skew of the sheet material is corrected at an upstream in the conveying direction of the sheet material relative to an image forming portion in which an image is formed on the sheet material.

When the skew of the skewed sheet material is corrected, the sheet material is warped between a member for correcting the skew and a conveying mechanism, generating a rotational force about the normal line of the paper surface is in the sheet. In other words, there are cases where the leading end of the sheet material, the skew of which has been corrected, is aligned in a direction orthogonal to the conveying direction, whereas a pair of rollers conveying the sheet material is sandwiching the sheet material still in a skewed manner. In some cases, therefore, a problem is posed that the sheet material which has undergone the correction of the skew is skewed again by the rotational force.

According to the sheet conveying apparatus disclosed in Japanese Patent Application Publication No. H02-18244, the conveying roller, which conveys the sheet material at the upstream of a resist roller, can be moved in a direction along the axis of rotation. The sheet conveying apparatus is adapted to correct the skew of a sheet material P by abutting the leading end of the sheet material P in a conveying direction T against a resist roller A. Further, a thrust force generated from the rotational force due to the warp of the sheet material P after the skew is corrected is removed by the movement of the conveying roller along the axis of rotation. This eliminates the aforesaid rotational force and solves the problem in that the sheet material P is skewed again after the correction of a skew.

Further, a plurality of conveying rollers that has moved by the thrust force is configured such that they can be reset to predetermined positions by being urged by coil springs from both sides in the axial direction (refer to Japanese Patent Application Publication No. H02-18244).

U.S. Pat. No. 7,533,878 discloses a solution to the warp of a sheet attributable to the correction of a skew. According to the solution, a feeding roller is supported by a movable arm member, and the nip (sandwiching) by the feeding roller and a pinch roller is cleared by moving the arm member.

In the sheet conveying apparatus disclosed in Japanese Patent Application Publication No. H02-18244 described above, a plurality of conveying rollers is always set such that they can be moved in the axial direction of a rotating shaft. This poses a problem in that the conveyance of a sheet material becomes unstable until the sheet material is abutted against a resist roller, which corrects the skew of the sheet material. Further, according to the sheet conveying apparatus disclosed in Japanese Patent Application Publication No. H02-18244, the conveying roller is integrally provided relative to the rotational direction of the rotating shaft. Hence, in the case where a relatively large correction amount of a skew of the sheet material is required, the warp of the sheet material may not be satisfactorily eliminated. For this reason, the sheet material P is required to be slipped relative to the conveying roller to some extent in order to fully eliminate the warp of the sheet material P that takes place between the conveying roller and the resist roller. On the other hand, however, it is necessary to minimize the slippage between the sheet material P and the conveying roller so as to obtain a sufficient conveying force for conveying the sheet material P. Satisfying these conflicting requirements is difficult.

As described above, according to the sheet conveying apparatus disclosed in Japanese Patent Application Publication No. H02-18244, it is difficult to achieve stable conveyance of a sheet material while restraining the sheet material from skewing at the same time. Thus, during the conveyance of the sheet material after the correction of the skew, differences are developed between both ends in the width direction of the sheet material in the conveying force and the conveying distance, leading to a skew of the sheet again. Applying the aforesaid sheet conveying apparatus to an image forming apparatus, especially a high image quality ink jet recording apparatus, would present a problem of uneven colors or uneven densities in an image recorded on a sheet material.

Further, the description of the construction disclosed in U.S. Pat. No. 7,533,878 provides no specific detail of the construction of a drive section for clearing the nip between the feeding roller and the pinch roller. There is a possible method in which, for example, the feeding roller is driven by an exclusive motor therefor, and the rotational direction of the motor is switch to control the movement of the arm member so as to clear the nip. This, however, would require the addition of a motor or a plurality of drive sections, resulting in a disadvantage of an increase in the manufacturing cost or an increased size of the apparatus.

SUMMARY OF THE INVENTION

To solve any one of the problems described above, an object of the present invention, therefore, is to provide a sheet conveying apparatus and a sheet conveying method that make it possible to restrain another skew of a sheet material, which tends to occur after a skew of the sheet material has been corrected, and also to stably convey a sheet material. The present invention also provides an image forming apparatus equipped with the sheet conveying apparatus.

To these ends described, the present invention provides a conveying apparatus which conveys a sheet along a conveying path, the conveying apparatus including; a first pair of rollers which has a drive roller and a pinch roller driven by the drive roller and which conveys the sheet in a conveying direction while sandwiching the sheet, a second pair of rollers which is provided on a downstream in the conveying direction in relation to the first pair of rollers and which conveys the sheet while sandwiching the sheet; and an arm member which supports the drive roller and which is constructed to be swingable such that a force for pressing the drive roller against the pinch roller increases as a conveyance resistance of the sheet increases, whereas the force for pressing the drive roller against the pinch roller decreases in the case of being driven by the sheet in movement, wherein the first pair of rollers and the second pair of rollers are driven such that a leading end of the sheet sandwiched by the first pair of rollers is pressed against the second pair of rollers which is rotating in a direction opposite from that of the first pair of rollers or at rest thereby to correct a skew of the sheet and such that a conveying speed of the second pair of rollers is higher than the conveying speed of the drive roller so as to cause the drive roller to be driven by the sheet in the case where the sheet having the skew corrected is conveyed by the second pair of rollers.

According to the present invention, a skew that occurs again after a skew of a sheet has been corrected can be restrained and the sheet can be stably conveyed.

Further features of the present invention will become apparent from the following description of exemplary embodiments with reference to the attached drawings.

DESCRIPTION OF THE EMBODIMENTS

Figure 1:
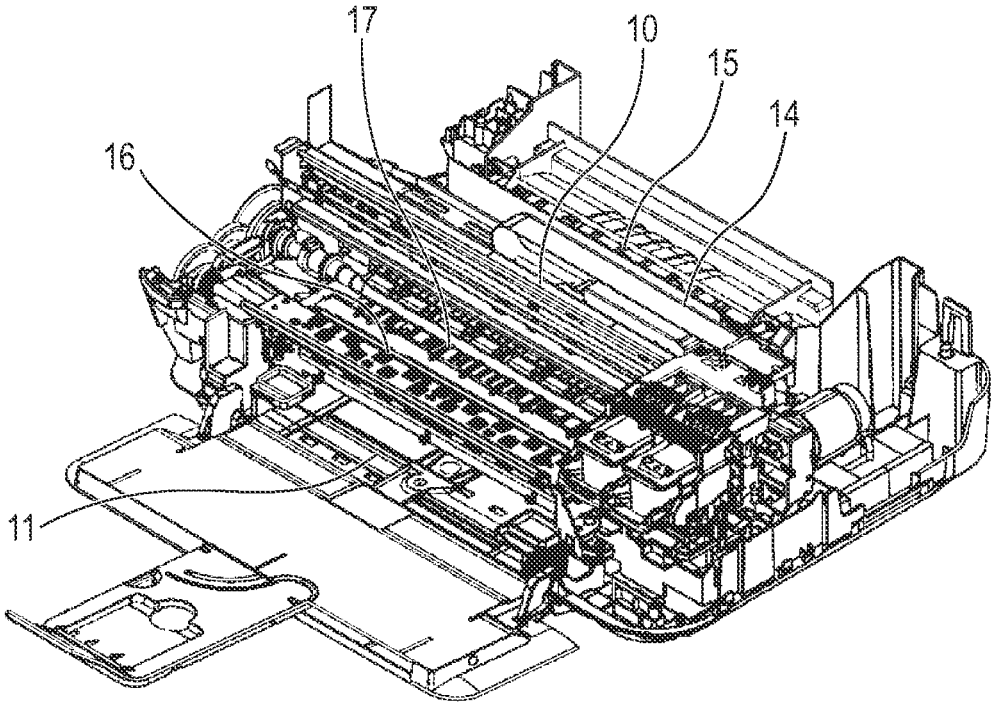
FIG. 1 is a perspective view of an image forming apparatus provided with a conveying apparatus according to an embodiment.
Figure 2:
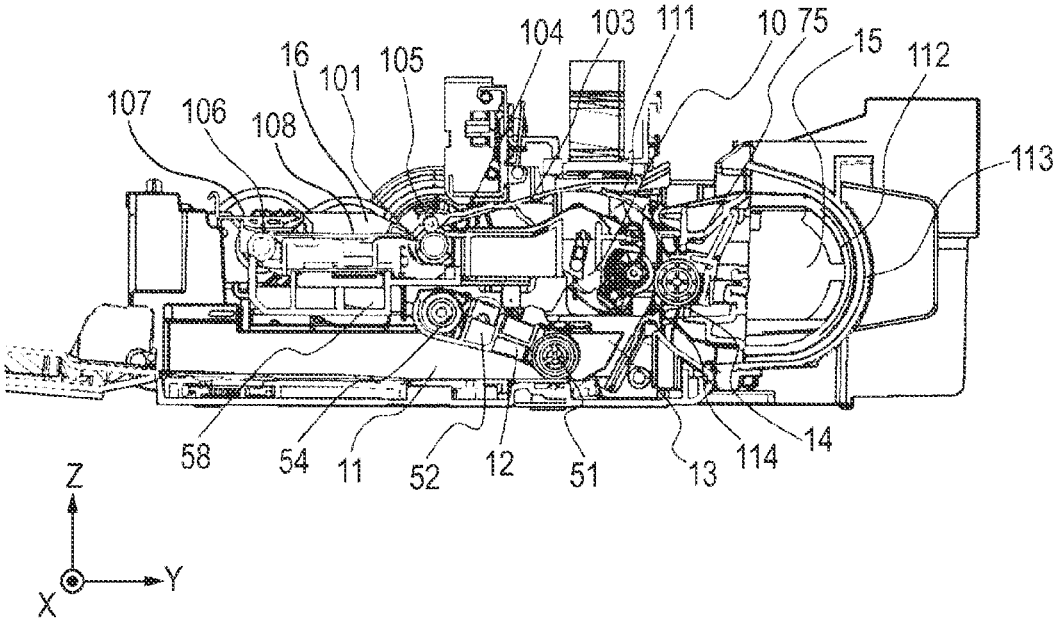
FIG. 2 is a longitudinal sectional view of the image forming apparatus provided with a conveying apparatus according to the embodiment.

The following will describe an embodiment of the present invention in detail with reference to the accompanying drawings. The same reference numerals throughout the accompanying drawings will refer to the same or corresponding portions. FIG. 1 is a perspective view of an image forming apparatus equipped with a conveying apparatus of an embodiment according to the present invention. FIG. 2 is a longitudinal sectional view of the image forming apparatus in FIG. 1. Referring to FIG. 1 and FIG. 2, a conveying apparatus 10 includes a sheet stacking portion 11, a feeding portion 12, a separating portion 13, a reversal conveying portion 14, a double-side conveying portion 15, and a horizontal conveying portion 16.

In the construction described above, one sheet is separated by the feeding portion 12 and the separating portion 13 from a bundle of sheets set on the sheet stacking portion 11 and then fed to the reversal conveying portion 14. The reversal conveying portion 14 has a U-shaped conveying path, and the front and the back of the sheet is reversed during its passage through the conveying path before the sheet is fed to the horizontal conveying portion 16. Then, the sheet passes through an image forming portion 17 and ejected (discharged) out of the apparatus. The image forming portion (image processing portion) 17 is constituted of a unit capable of forming an image (processing an image) on a sheet of a recording portion or a reading portion.

Construction of the Sheet Stacking Portion

Figure 3:
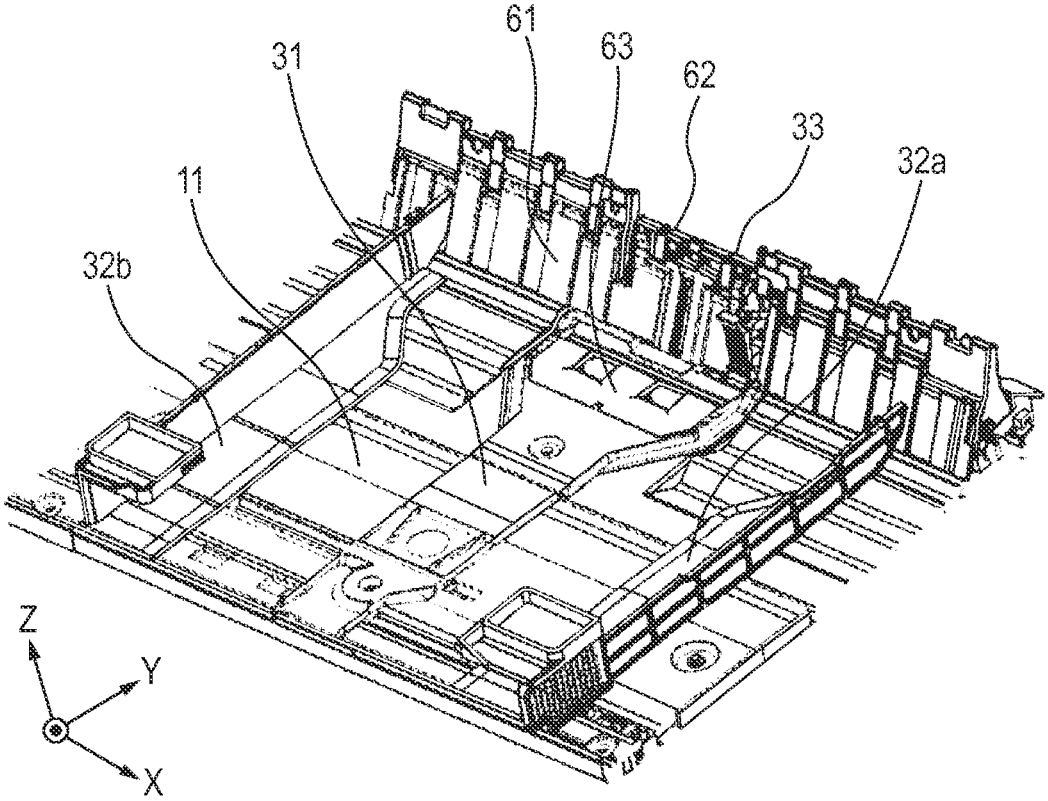
FIG. 3 is a perspective view of a sheet stacking portion of the conveying apparatus with no sheet set thereon.
Figure 4:
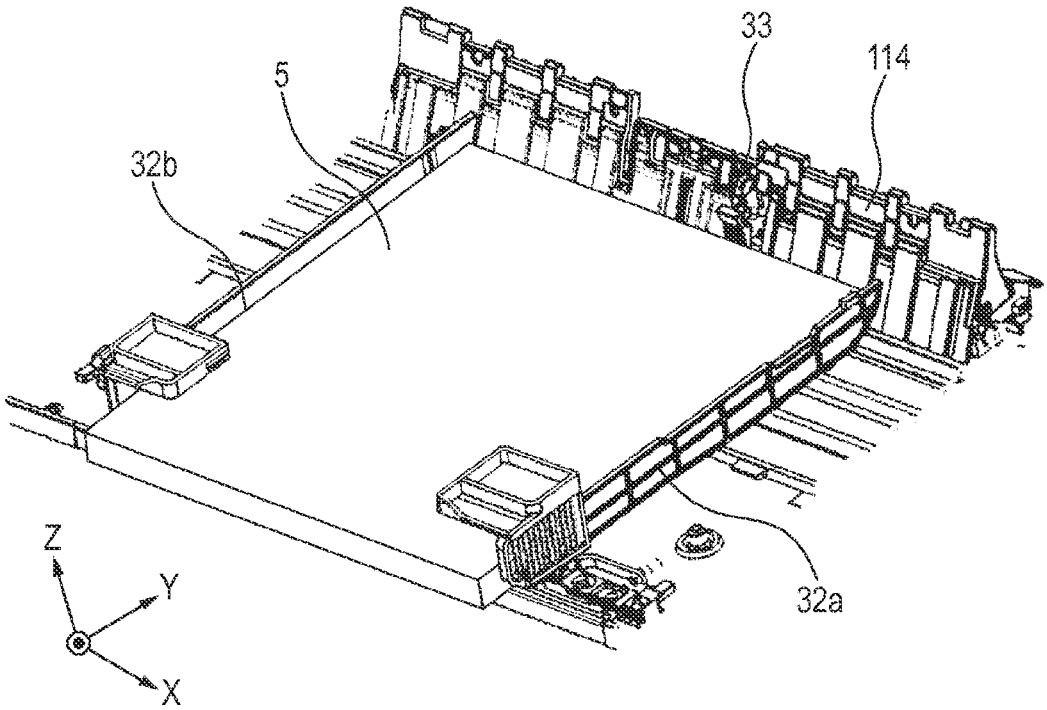
FIG. 4 is a perspective view of the sheet stacking portion of the conveying apparatus with sheets set thereon.

The construction of the sheet stacking portion 11 will now be described. FIG. 3 is a perspective view of the sheet stacking portion 11 with no sheet set thereon, which is observed from above at an angle. FIG. 4 is a perspective view of the sheet stacking portion 11 with sheets set thereon, which is observed from above at an angle. Referring to FIGS. 3 and 4, the sheet stacking portion 11 includes a sheet stacking plate 31 for holding a plurality of sheets S substantially in a horizontal position, side guides 32*a* and 32*b* for guiding both sides of the sheets S, and a leading end reference plate 33 for guiding the leading end of the sheets S. The leading end reference plate 33 is swingably provided and always set to be substantially at a right angle with respect to the feeding direction of the sheets S except when a feeding operation is performed. The leading end reference plate 33 provides the abutting reference for a user to set the sheets S. Meanwhile, when a sheet is fed, the leading end reference plate 33 is retracted clear of the conveying path.

Feeding Portion

Figure 5:
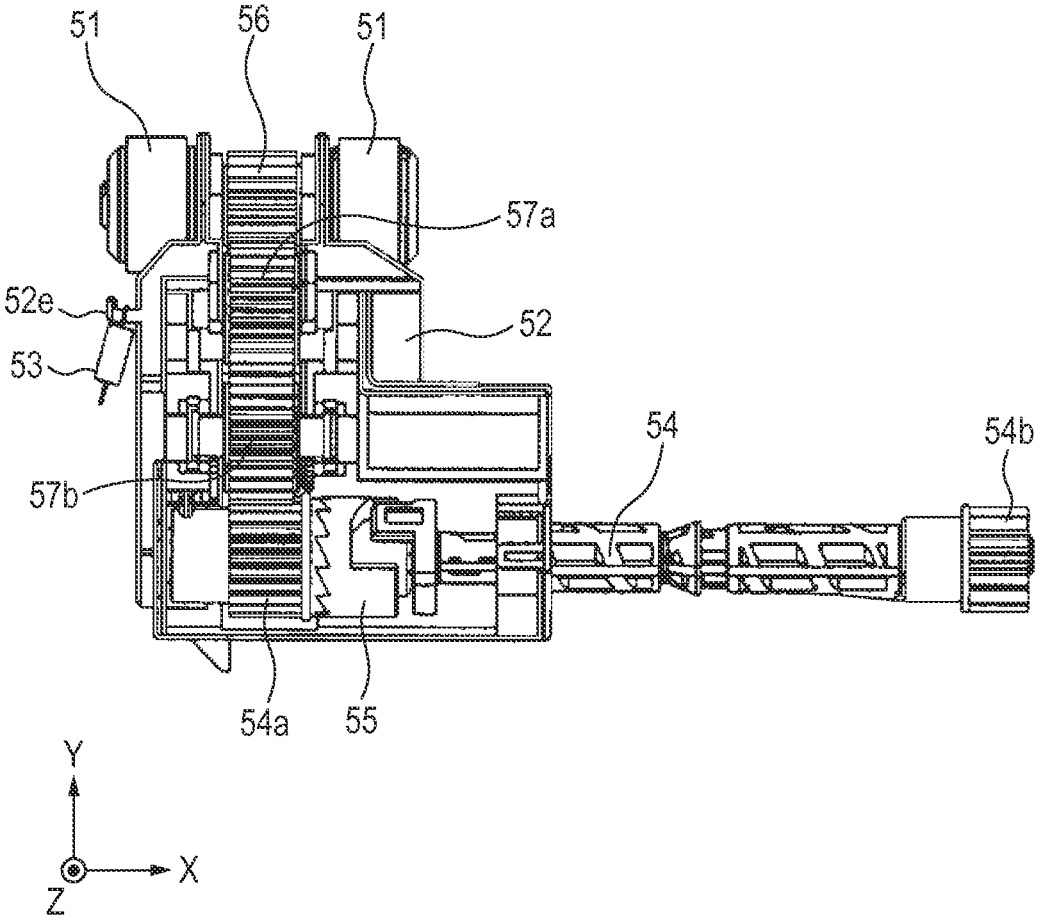
FIG. 5 is a rear view of an embodiment of a feeding unit of the conveying apparatus.

The construction of the feeding portion 12 will now be described. FIG. 5 is a rear view illustrating a feeding unit constituting the feeding portion 12, which is observed from below. The feeding portion 12 has a feeding roller 51 and a swing arm 52, which swingably supports the feeding roller 51 (refer also to FIG. 2). An urging spring 53 is provided as a spring device tightly stretched between a hook 52*e* of the swing arm 52 and a hook (not shown) of a feeding base 58. The feeding portion 12 further includes a drive shaft 54 for transmitting drive to the feeding roller 51, an output gear 54*a* of the drive shaft 54, and an input gear 54*b* for transmitting the drive from a drive source (not shown) to the drive shaft 54. A one-way clutch 55 for transmitting torque only in one direction is installed between the input gear 54*b* and the output gear 54*a*. The one-way clutch 55 is adapted to transmit torque from the input gear 54*b* to the output gear 54*a* when the feeding roller 51 rotates in the direction in which the feeding roller 51 conveys a sheet. The swing arm 52 rotatively supports idler gears 57*a* and 57*b* for transmitting the drive from the output gear 54*a* of the drive shaft 54 to a feeding roller gear 56. The swing arm 52 is rotationally (swingably) installed on the bottom surface of the feeding base 58. The drive shaft 54 is also rotatively supported in a fitted manner by the feeding base 58 coaxially with the swing pivot point of the swing arm 52.

Separating Portion

Figure 6:
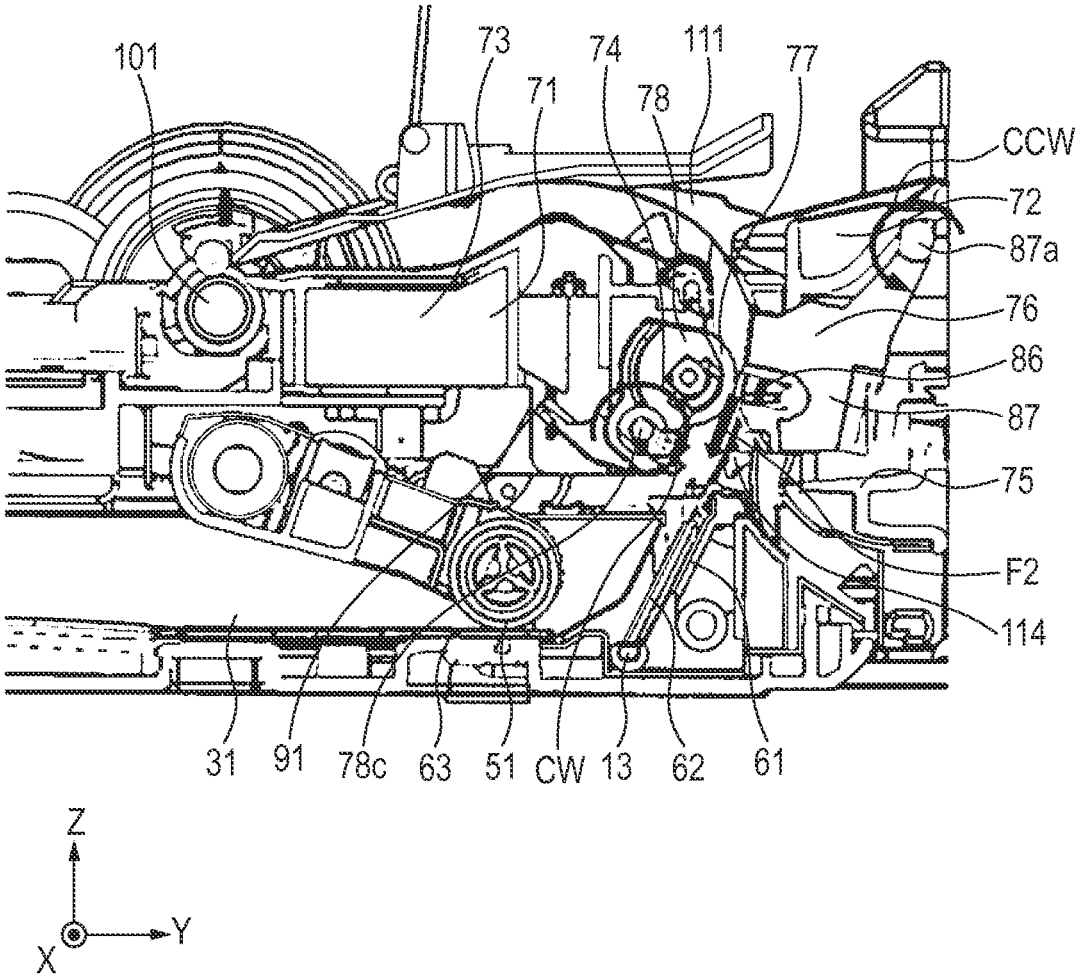
FIG. 6 is a longitudinal sectional view illustrating a feeding portion, a separating portion, a reversal conveying portion, and a horizontal conveying portion.

FIG. 6 is a longitudinal sectional view of the feeding portion 12, the separating portion 13, the reversal conveying portion 14, and the horizontal conveying portion 16. Referring to FIGS. 3 and 6, the construction of the separating portion 13 will be described. The separating portion 13 is preferably a separating slope type, which is advantageous costwise. In the present embodiment, the separating portion 13 functions as a separating slope and has a slope 61 having a plane inclined with respect to the feeding direction, a separating aid member 62 provided at the middle of the slope 61, and a separating sheet 63 installed on the sheet stacking plate 31. The separating aid member 62 slightly projects above the slope of the slope 61 and comes in contact with the leading end of the sheet S to apply resistance thereto when the sheet S is fed. Further, the separating aid member 62 is movably mounted in the horizontal direction and adapted to retract when firmly pressed with a predetermined load. In the present construction, when the feeding roller 51 is rotatively driven, the sheet S stacked on the sheet stacking portion 11 is fed out while being pressed by the feeding roller 51. When the leading ends of the sheets S are pressed against the separating aid member 62 and the slope 61 and subjected to the resistance, the uppermost sheet is separated from the sheets thereunder (the next uppermost and the remaining sheets) by the frictional force applied to the waists (the middle parts) of the sheets and the leading ends of the sheet S. Thus, only one sheet S is fed out to the conveying path.

Reversal Conveying Portion

Figure 7:
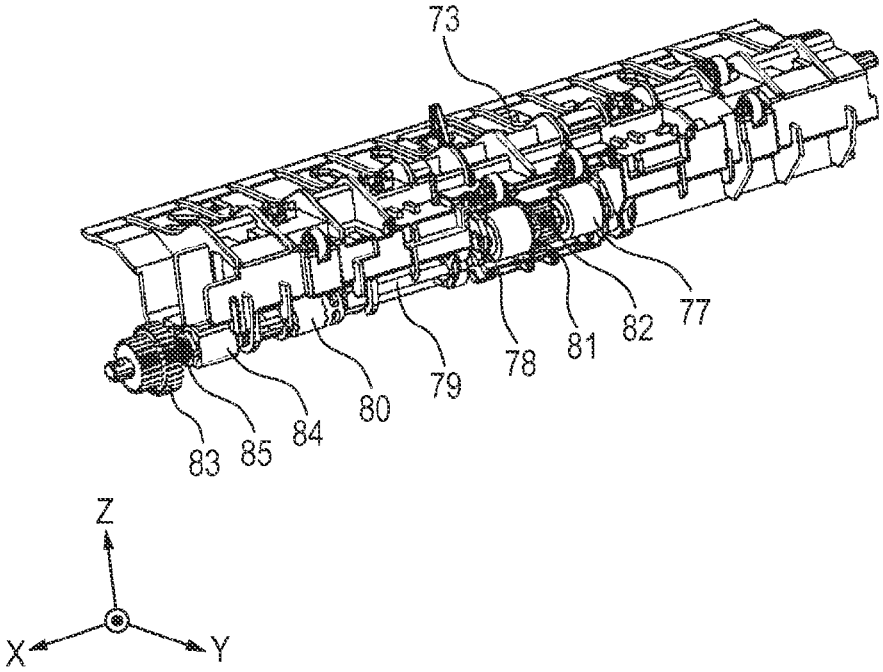
FIG. 7 is a perspective view of an inner guide unit constituting the reversal conveying portion observed from above.
Figure 8:
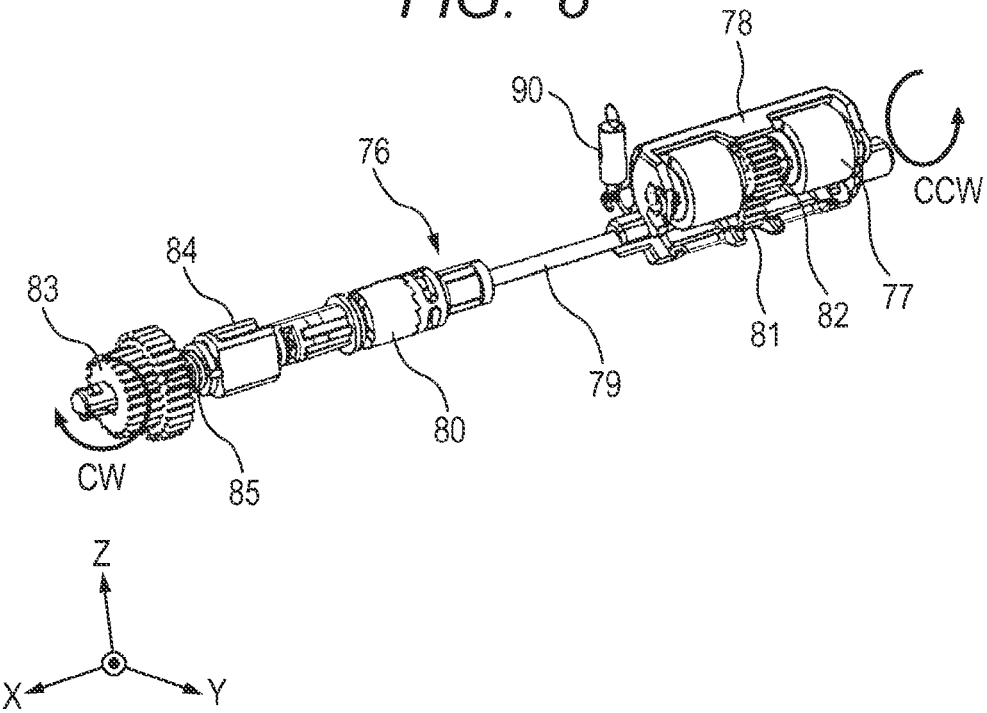
FIG. 8 is a perspective view of a PF roller unit observed from above.
Figure 9:
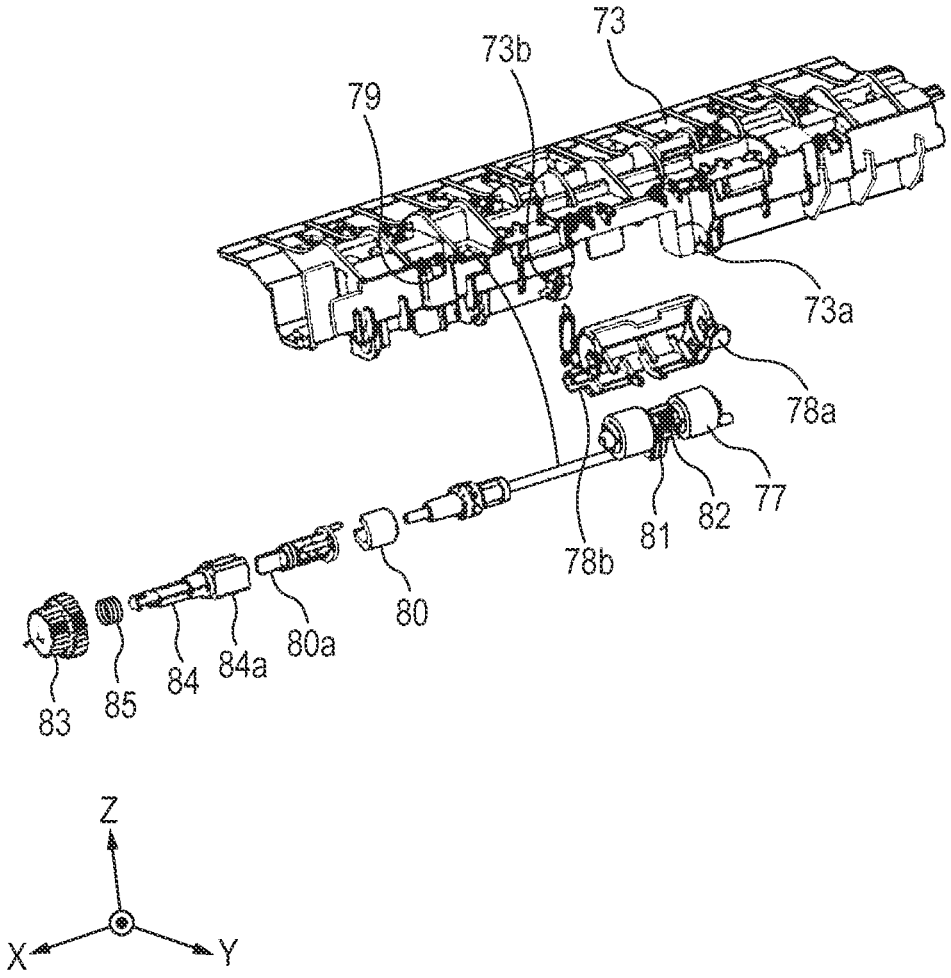
FIG. 9 is an exploded view of the inner guide unit.
Figure 10:
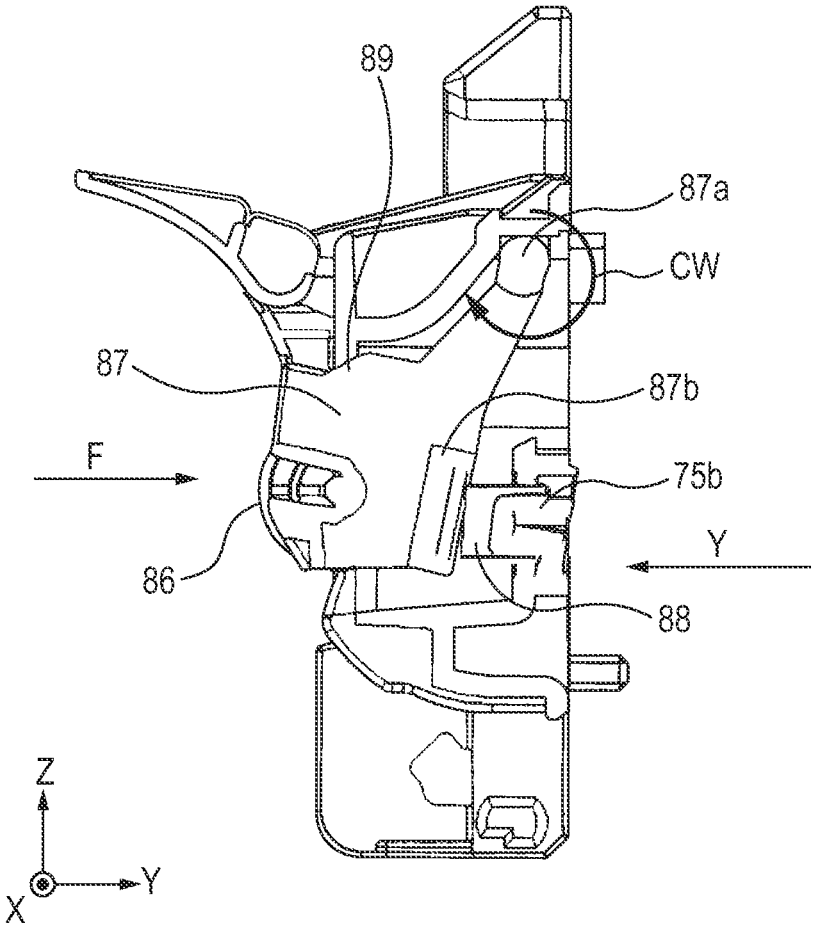
FIG. 10 is a sectional view of an outer guide unit constituting the reversal conveying portion.
Figure 11:
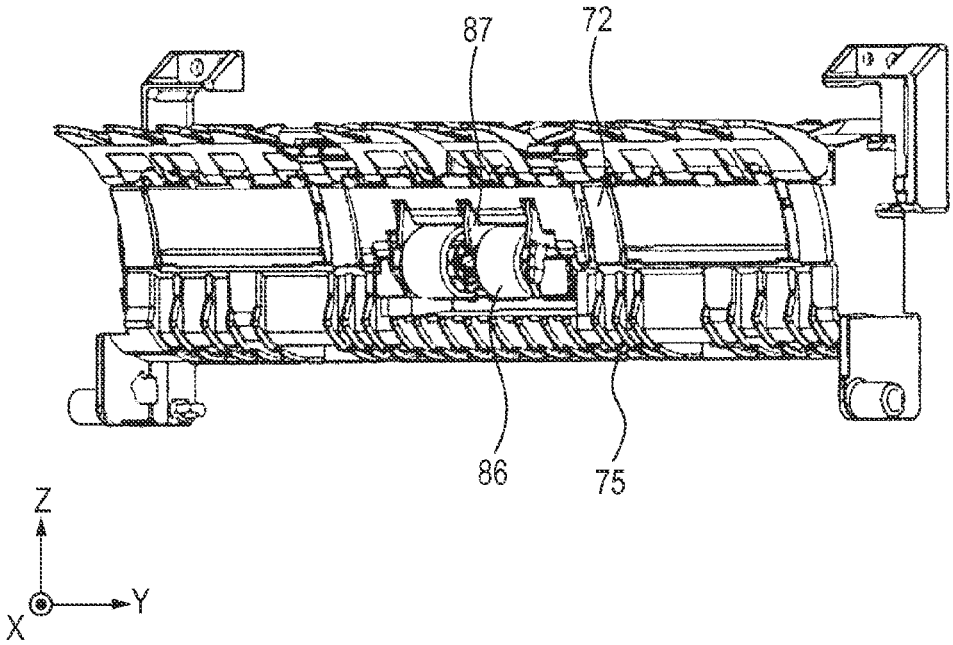
FIG. 11 is a perspective view of the outer guide unit observed from the front at an angle.

The construction of the reversal conveying portion 14 will now be described. FIG. 7 is a perspective view of an inner guide unit 71 constituting the reversal conveying portion 14, which is observed from above (refer also to FIG. 6). FIG. 8 is a perspective view of a PF roller unit 74 observed from above (refer also to FIG. 6). FIG. 9 is an exploded view of the inner guide unit 71. FIG. 10 is a sectional view of an outer guide unit 72 constituting the reversal conveying portion 14 (refer also to FIG. 6). FIG. 11 is a perspective view of the outer guide unit 72 observed from the front at an angle.

The reversal conveying portion 14 is provided with the inner guide unit 71 and the outer guide unit 72. The inner guide unit 71 has an inner guide 73, which forms an inner guide of a reversal conveying path for reversing the front and the back of a sheet and which supports members to be discussed later, and a PF roller unit 74, which conveys the sheet in the reversal conveying path. The outer guide unit 72 is provided with an outer guide 75, which forms an outer guide of the reversal conveying path and which supports members to be discussed later, and a PF pinch roller unit 76, which conveys the sheet jointly with the PF roller unit 74. The reversal conveying path has a curved path.

Referring to FIG. 7, FIG. 8 and FIG. 9, a PF roller 77 has a highly frictional member, such as a rubber member, around its outer periphery and is rotatively supported by the distal end of a PF arm (arm member) 78. The PF arm 78 is swingably supported by shafts 78*a* and 78*b*, which are formed integrally with the PF arm and which are rotatively supported by holes 73*a* and 73*b* in the inner guide. One end of a PF shaft 79 is rotatively supported in a hole formed coaxially with the shaft 78*a* of the PF arm, while the other end thereof is rotatively supported by the inner guide 73 through the intermediary of a clutch 80. In this state, a rotation restricting portion 91 formed on the inner guide 73 and an engaging portion of the PF arm 78 allow the PF arm 78 to be swung within a predetermined range. A swing supporting point 78*c* of the PF arm 78 is set on an upstream side relative to the conveying direction of the sheet conveyed along the reversal conveying path, the contact point of the sheet and the PF roller 77 being the reference. Further, a PF output gear 81 is secured to the other end of the PF shaft 79, and the PF output gear 81 meshes with a PF roller gear 82, which integrally rotates with the PF roller 77. Formed on one end of the clutch 80 is a flat engaging portion 80*a*. The PF output gear 81 rotates about an axis common to the swing center axis of the PF arm 78. Meanwhile, a groove 84*a* engaging with the engaging portion 80*a* is formed in the PF gear shaft 84, which rotates integrally with a PF input gear 83 connected with a drive source (not shown). The PF gear shaft 84 has a clutch spring 85 installed thereto and can be rotated only in one direction by fixing one end of the clutch spring 85 to a drive frame (not shown).

With the construction described above, when the PF input gear 83 rotates clockwise (in the direction indicated by CW in the figure), the clutch spring 85 loosens, allowing the PF gear shaft 84 to rotate. This causes a driving force to be transmitted to the PF shaft 79 through the intermediary of the engaging portion 80*a*, the groove 84*a*, and the clutch 80, thus rotating the PF output gear 81 clockwise. As a result, the PF roller gear 82 and the PF roller 77 rotate counterclockwise (in the direction indicated by CCW in the figure), that is, rotate in the direction in which the sheet is conveyed. The direction of rotation of the PF output gear 81 in this case is the same as the direction in which the PF arm 78 swings to press the PF roller 77 against a PF pinch roller 86. Meanwhile, if the PF roller 77 is rotated in the conveying direction (the CCW direction) in a state in which the drive of the PF input gear 83 is cut off, then the drive of the PF shaft 79 and the PF gear shaft 84 is cut off by the action of the clutch 80. Hence, the clutch spring 85 loosens and the torque is not applied, thus allowing the PF roller 77 to rotate at a low driving torque.

Further, if the PF roller 77 is rotated clockwise (the CW direction) in the state in which the drive of the PF input gear 83 is cut off, then the drive is transmitted to the PF gear shaft 84 by the action of the clutch 80, but the PF gear shaft 84 cannot rotate, because the clutch spring 85 closes.

The PF arm 78 is provided with a precompression spring 90 in which an urging force is generated clockwise (in the CW direction) in FIG. 6 and remains at rest in contact with the PF pinch roller 86, which will be discussed later, by the action of the precompression spring 90. As an example, the precompression spring 90 has generated an urging force of 30 gf (approximately 0.294N). The PF pinch roller 86 is pressed against the PF arm 78 and rotatively driven by the drive of the PF arm 78. The PF arm (a drive roller) 78 and the PF pinch roller (a pinch roller) 86 constitute a first pair of rollers that conveys a sheet while sandwiching the sheet.

Referring to FIG. 10 and FIG. 11, the PF pinch roller (the aforesaid pinch roller) 86 is rotatively supported by one end of the PF pinch roller holder 87. The PF pinch roller holder 87 is swingably supported by being supported by supporting a shaft 87*a* integrally formed on the PF pinch roller holder by the hole formed in the outer guide 75. A PF pinch roller spring 88 is provided between a rear surface 87*b* of the PF pinch roller holder 87 and an opposing portion 75*b* of the outer guide 75. The PF pinch roller holder 87 is urged in the direction of an arrow X by the PF pinch roller spring 88, and the position the PF pinch roller holder 87 is restricted by a stopper 89 provided on the outer guide 75.

Figure 12:
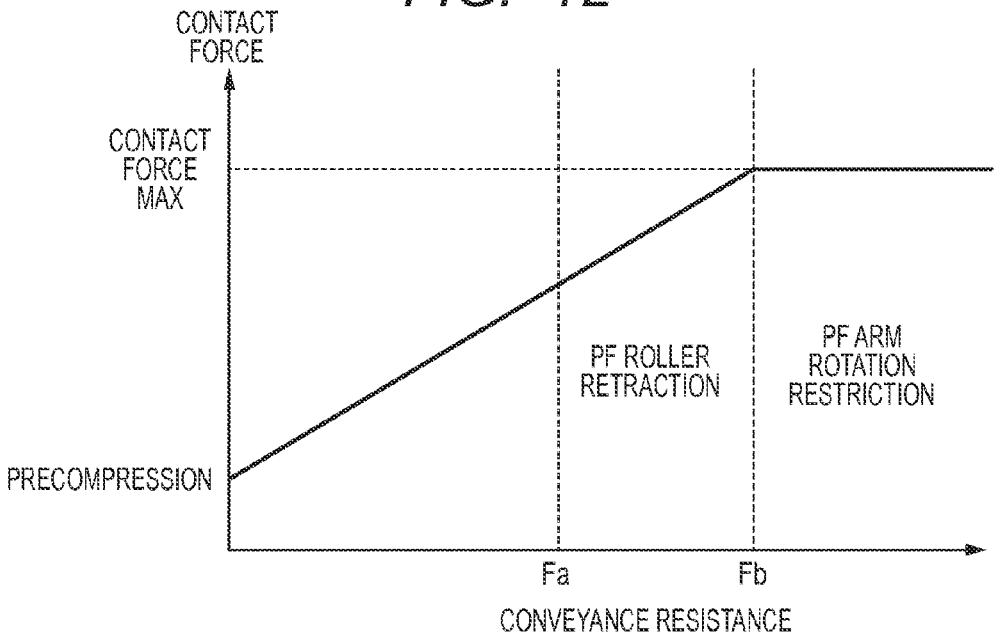
FIG. 12 is a graph illustrating a conveyance resistance of a sheet and a contact force between a PF roller and a PF pinch roller generated according to the conveyance resistance.

The conveyance resistance of the sheet and the contact force between the PF roller 77 and the PF pinch roller 86 will now be described. FIG. 12 is a graph illustrating the conveyance resistance of the sheet and the contact force generated accordingly between the PF roller 77 and the PF pinch roller 86. The contact force between the PF roller 77 and the PF pinch roller 86 is defined by the forces of the two rollers pressing against each other. In the graph of FIG. 12, the axis of abscissas indicates the conveyance resistance of the sheet and the axis of ordinates indicates the contact force between the PF roller 77 and the PF pinch roller 86.

Referring to FIG. 6, the PF arm 78 is constructed such that it may swing in a direction for increasing the urging force imparted by the PF roller 77 to the PF pinch roller 86 by the couple of force generated in the PF roller 77 by conveyance resistance F2 of the sheet (i.e., the PF arm 78 swings in the CW direction). In other words, the PF arm 78 swings to press the PF roller 77 against the PF pinch roller 86 more firmly as the conveyance resistance of the sheet increases, thus generating a frictional force based on the conveyance resistance F2. As shown in FIG. 12, the contact force between the PF roller 77 and the PF pinch roller 86 consists of only the force (precompression) generated by the precompression spring 90 in a standby mode, in which no conveyance resistance is generated. If the conveyance resistance F2 increases during the conveyance of the sheet, then the couple of force acting on the PF arm 78 leads to the generation of the contact force based on the conveyance resistance F2. The conveyance resistance F2 acts on the PF arm 78 through the intermediary of the PF roller 77, and the rotational force of the PF output gear 81 also acts thereon through the intermediary of the PF roller gear 82. These forces provide the torque that rotates the PF arm 78. If the conveyance resistance F2 further increases into a contact force that exceeds the urging force generated in the PF pinch roller spring 88 (the section from Fa to Fb of FIG. 12), then the PF pinch roller holder 87 retracts by rotating counterclockwise (in the CCW direction in the drawing) about the supporting point (shaft) 87*a*. Following this, the PF arm 78 swings (turns) clockwise (in the CW direction in the drawing). If the conveyance resistance F2 further increases, then the swing of the PF arm 78 is restricted by the rotation restricting portion 91, thus preventing the contact force from increasing.

Horizontal Conveying Portion

The horizontal conveying portion 16 will now be described. Referring to FIG. 2, an LF roller 101 is comprised of a metal shaft having the surface thereof coated with minute ceramic particles, and the metal portions of both ends thereof are supported by bearings mounted on a chassis. A pinch roller holder 103 retains a plurality of pinch rollers 105 urged toward the surface of the LF roller 101 by a pinch roller spring 104, and the pinch rollers 105 contact the surface of the LF roller 101 to follow the movement thereof. The LF roller 101 and the pinch roller 105 constitute a second pair of rollers, which sandwiches and conveys the sheet. The second pair of rollers 101 and 105 is provided on the downstream side in the sheet conveying direction relative to the aforesaid first pair of rollers 77 and 86. A discharging roller 106 is comprised of a metal shaft with a plurality of rubber rollers inserted and fixed therein. A spurring holder 107 has a plurality of spurs installed thereto, the spurs being pressed toward the discharging roller 106 by a spur spring composed of a bar-shaped coil spring. A platen 108 is constructed to support the bottom surface of the sheet between the LF roller 101 and the discharging roller 106.

An image forming apparatus is disposed, opposing the platen 108, and has an image forming portion 17, which forms an image on the sheet. More specifically, the image forming portion is provided on the downstream side in the sheet conveying direction in relation to the LF roller 101 and the pinch roller 105.

Double-Side Conveying Portion

The double-side conveying portion 15 will now be described. The double-side conveying portion 15 has a different conveying path (a double-side conveying path) between the pair of the LF roller 101 and the pinch roller 105 and the pair of the PF roller 77 and the PF pinch roller 86. Referring to FIG. 2 and FIG. 6, a double-side feeding flapper 111 is disposed at a position where the double-side conveying path merges with a reversal conveying path at an uppermost upstream of the double-side conveying path, one end thereof being rotatively supported by the outer guide 75. The upper surface of the double-side feeding flapper 111 functions as a double-side conveying guide by coming in contact with the inner guide 73 by its own weight in a standby state. The lower surface of the double-side feeding flapper 111 rotates by the sheet that is being conveyed in the reversal conveying path and functions as a conveying guide surface that connects the outer guide 75 and the guiding surface of the pinch roller holder 103. Provided at the rear of the outer guide 75 are a double-side inner guide 112 that forms the wall surface on the inner peripheral side of the double-side conveying path and a double-side outer guide 113 that forms the wall surface on the outer peripheral side of the double-side conveying path. A double-side discharging flapper 114 is disposed at a position where the double-side conveying path merges with the reversal conveying path at a lowermost downstream of the double-side conveying path, one end thereof being rotatively supported by the slope 61. The double-side discharging flapper 114 remains at rest by its own weight such that the flapper 114 forms the guiding surface of the reversal conveying path in a standby state, while the flapper 114 forms the guiding surface of the double-side conveying path when the flapper rotates counterclockwise against the sheet that is being conveyed along the double-side conveying path.

Drive Train

Figure 13:
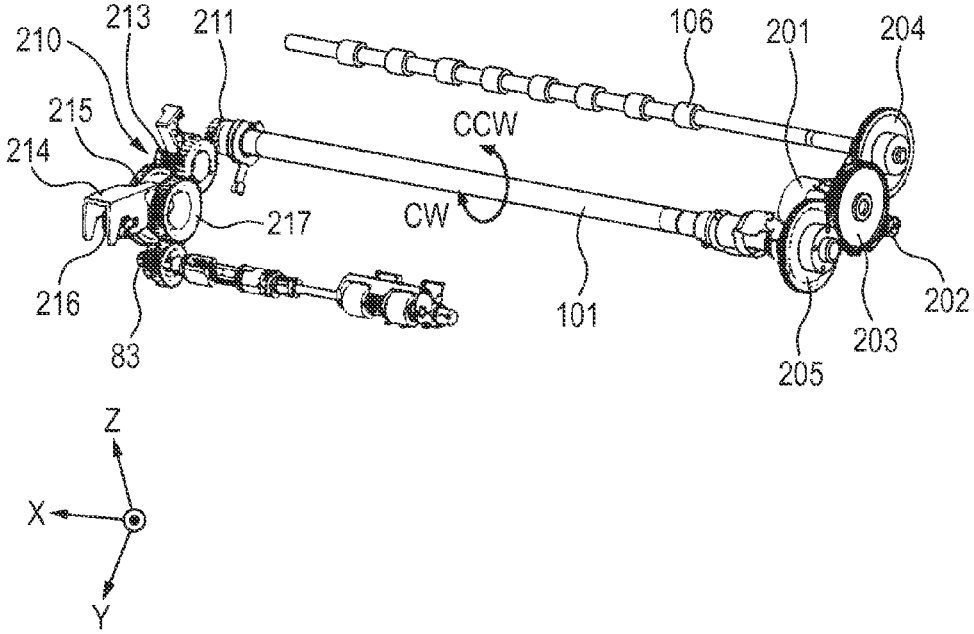
FIG. 13 is a perspective view of an entire drive train that drives the PF roller, an LF roller, and a discharging roller observed from above at the rear.
Figure 14:
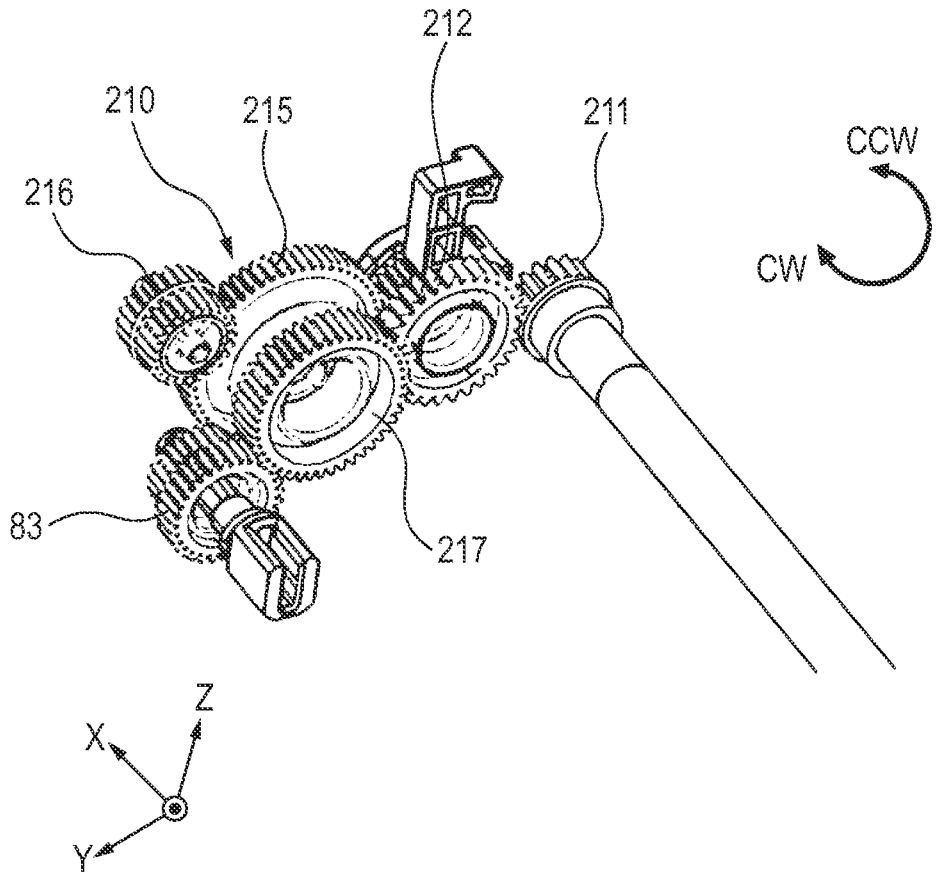
FIG. 14 is a perspective view of the drive train observed from above, the drive train transmitting the drive from the LF roller to a PF roller unit.
Figure 15:
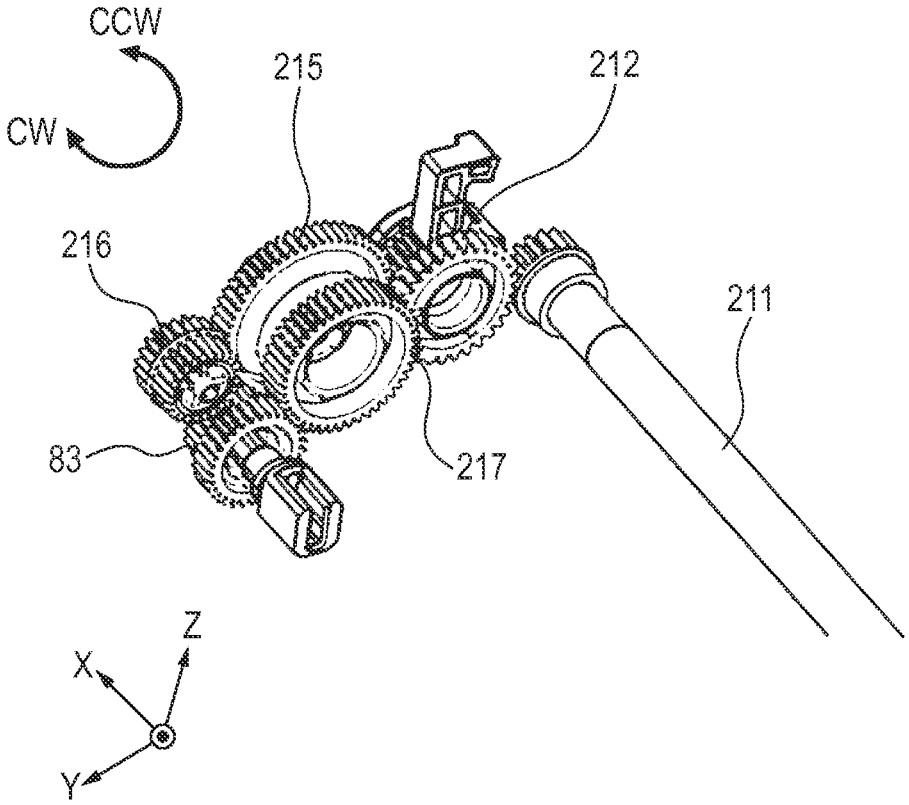
FIG. 15 is another perspective view of the drive train observed from above, the drive train transmitting the drive from the LF roller to a PF roller unit.
Figure 16:
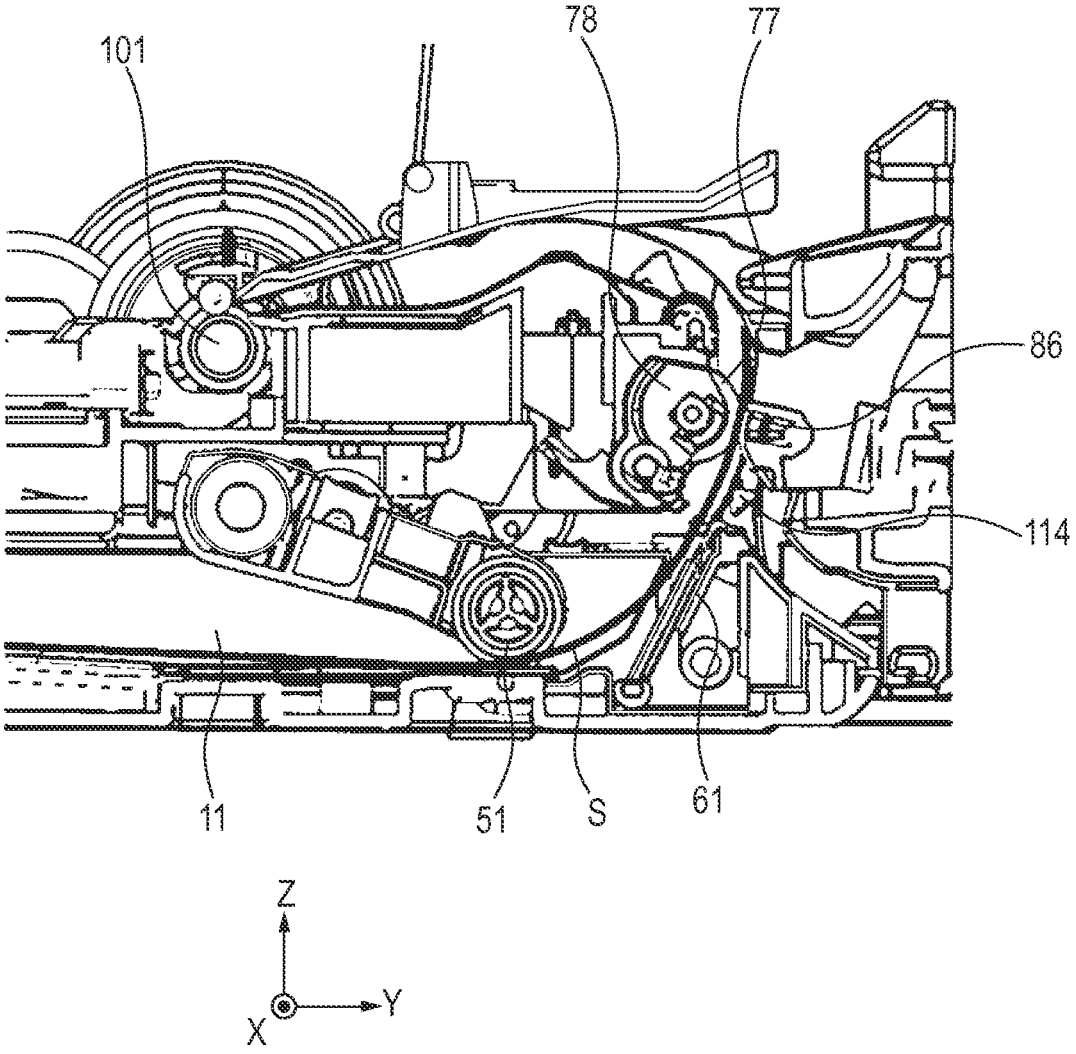
FIG. 16 is a diagram illustrating the position and the state of a sheet at timing after feeding is begun.
Figure 17:
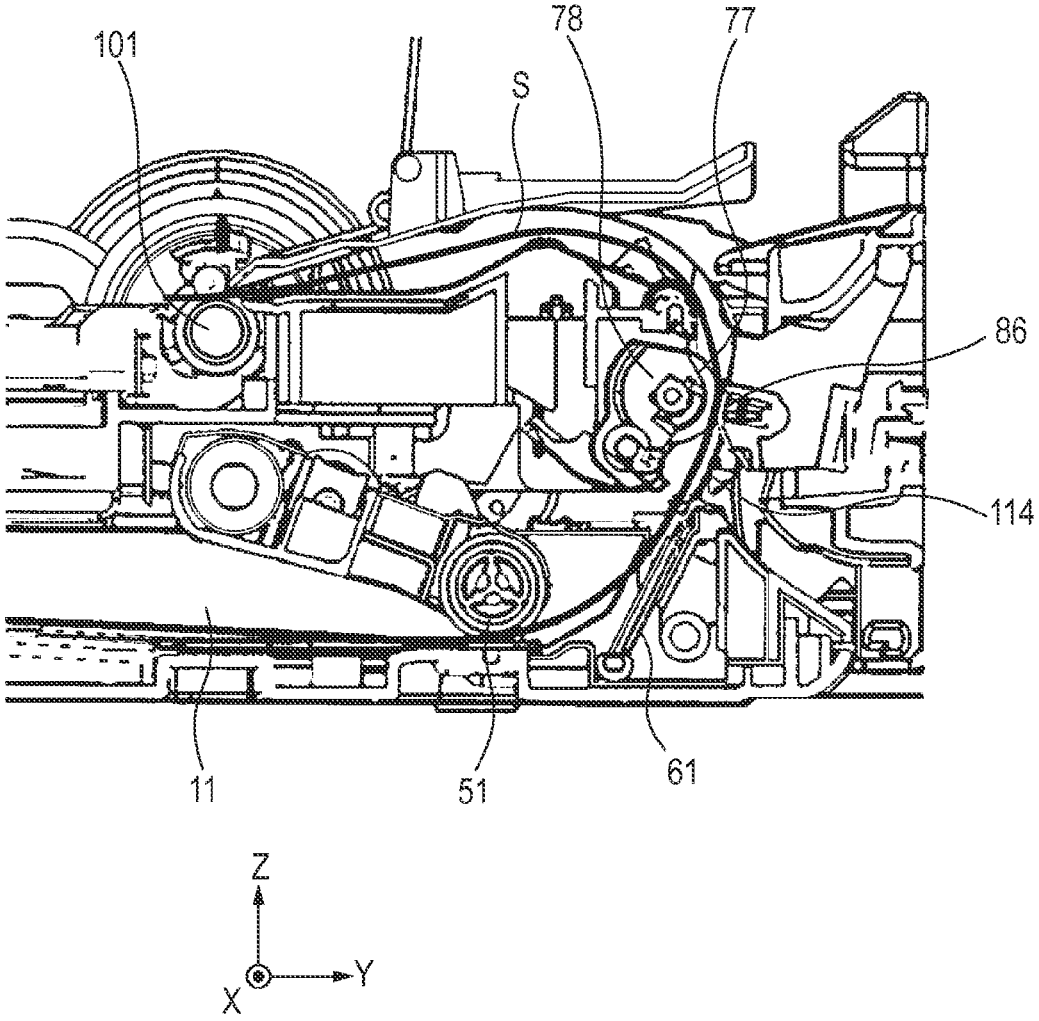
FIG. 17 is a diagram illustrating the position and the state of the sheet at certain timing after the timing illustrated in FIG. 16.
Figure 18:
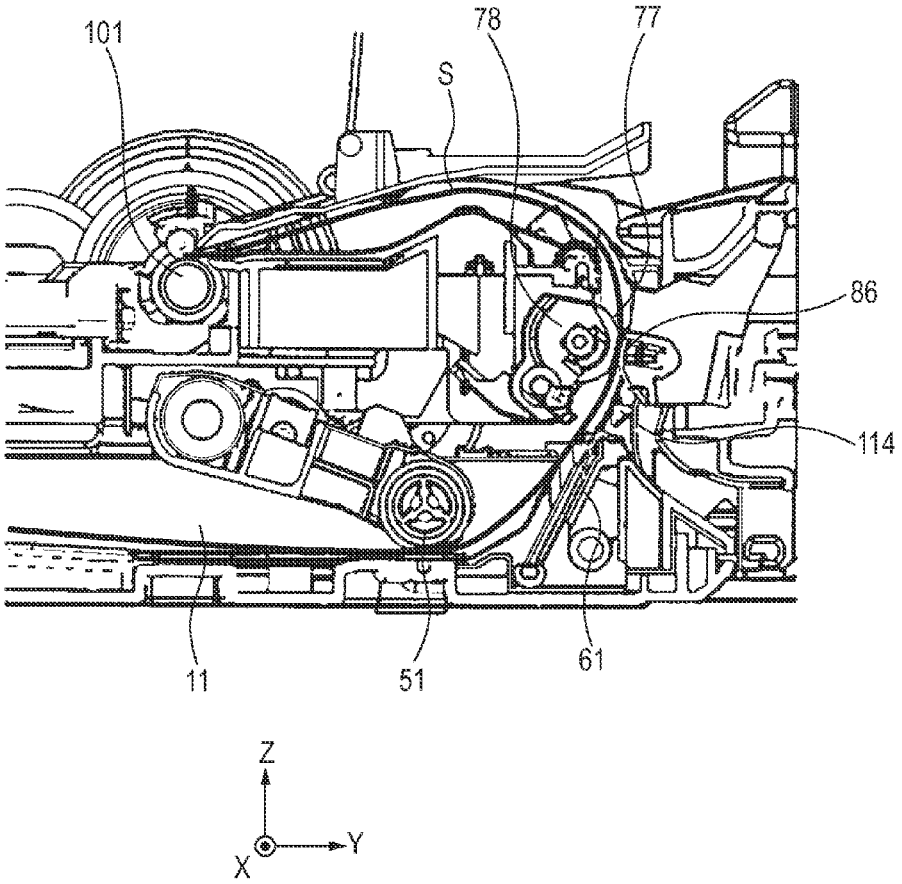
FIG. 18 is a diagram illustrating the position and the state of the sheet at certain timing after the timing illustrated in FIG. 17.
Figure 19:
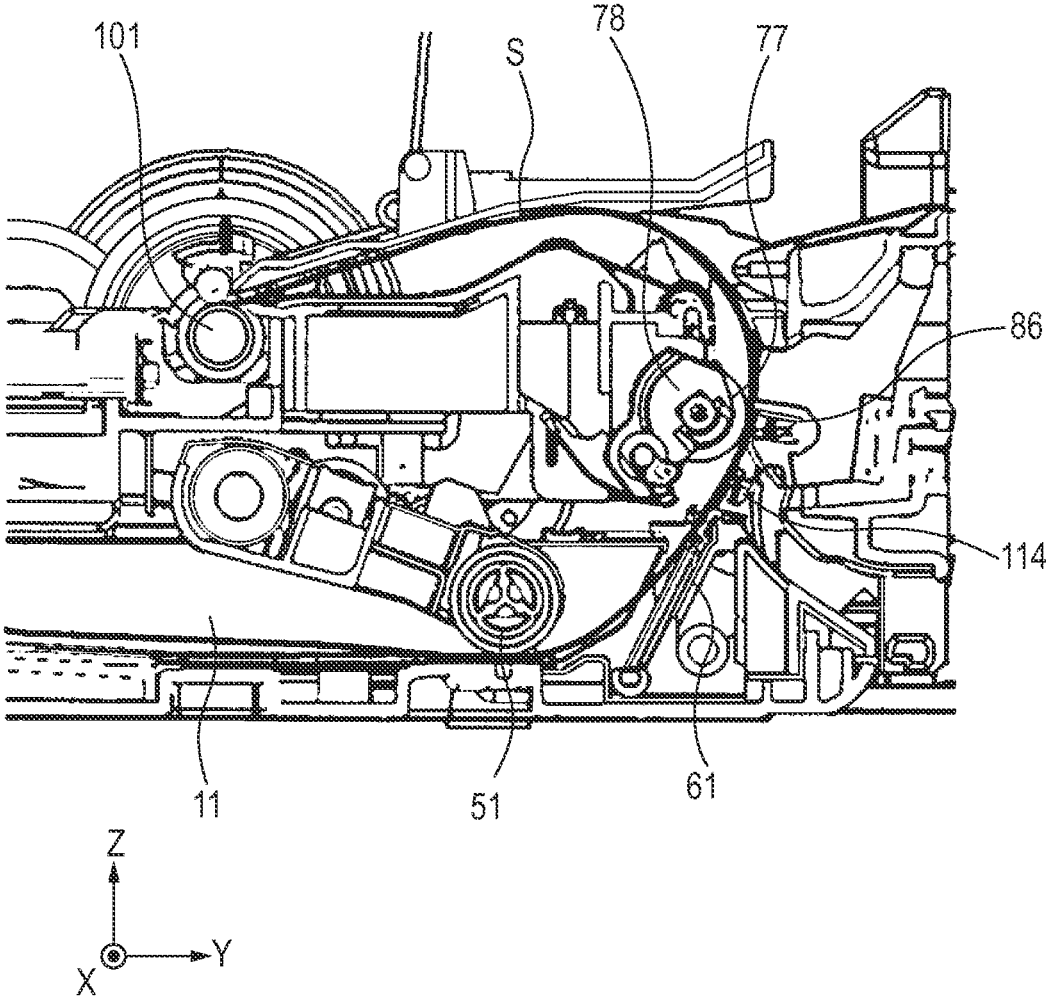
FIG. 19 is a diagram illustrating the position and the state of the sheet at certain timing after the timing illustrated in FIG. 18.
Figure 20:
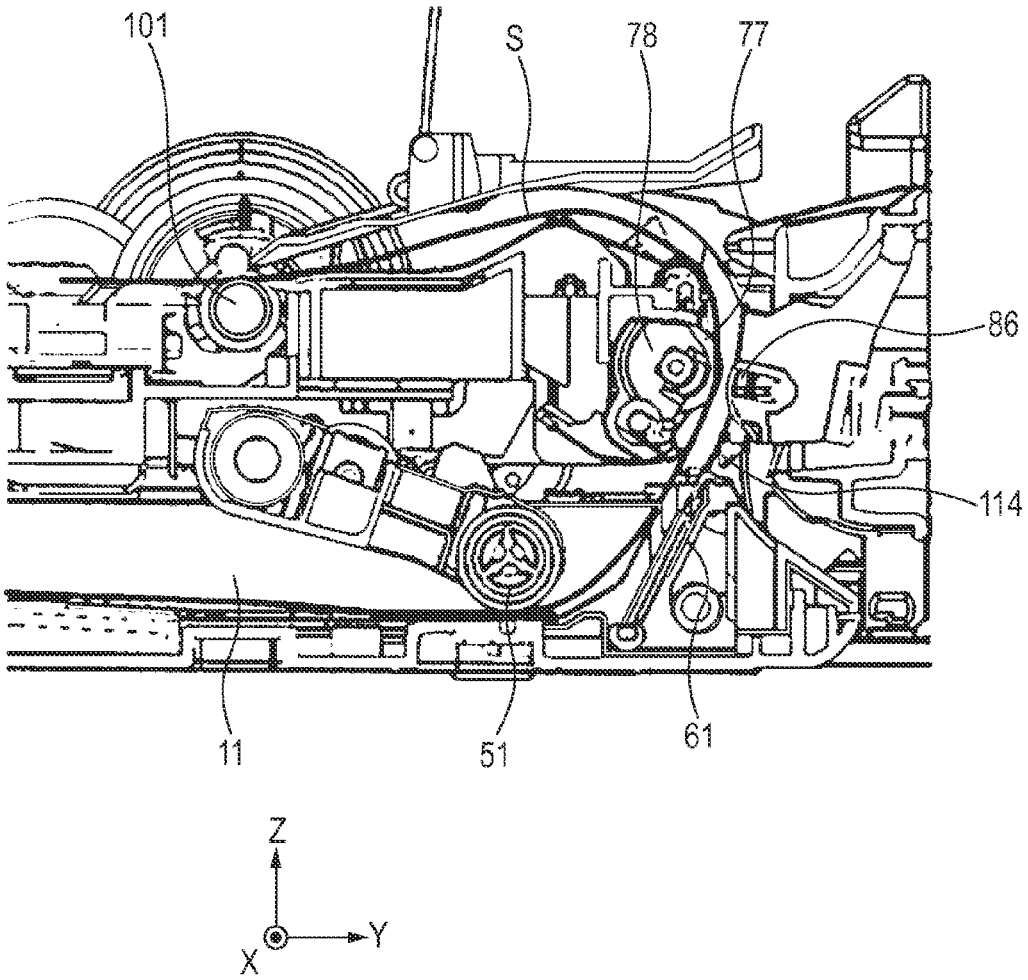
FIG. 20 is a diagram illustrating the position and the state of the sheet at certain timing after the timing illustrated in FIG. 19.

The construction of the drive train will now be described. FIG. 13 is a top rear perspective view of the entire drive train that drives the PF roller 77, the LF roller 101, and the discharging roller 106. FIG. 14 and FIG. 15 are perspective views of the drive train observed from above, the drive train transmitting the drive from the LF roller 101 to the PF roller unit 74.

The drive of a conveying motor 201, which is a drive source, is transmitted to a discharging roller gear 204 attached to one end of the discharging roller 106 through the intermediary of a pinion gear 202 and an idler gear 203. Further, the idler gear 203 is also connected to an LF roller gear 205 attached to one end of the LF roller 101, so that the drive from the conveying motor 201 is transmitted also to the LF roller 101. In the case, as an example, the rotation ratio between the LF roller 101 and the discharging roller 106 is set to 1:1, and the rotation ratio between the LF roller gear 205 and the discharging roller gear 204 is also set to 1:1. With this arrangement, the rotation period of the LF roller 101, the rotation period of the discharging roller 106 and the rotation period of a transmission gear 217 are the same, and the error of a conveyance amount attributable to the eccentricities of the rollers 101 and 106 will appear at the same period as the rotations of the rollers 101 and 106. A code wheel having slits formed at a pitch of 150 to 360 lpi is directly connected coaxially with the LF roller 101. An LF roller encoder sensor reads the number and timing of passages of the slits in the code wheel to carry out the control of the rotational amount and the rotational speed of the conveying motor 201. The conveying motor 201 is controlled by a control portion B1, which will be discussed hereinafter.

A PF roller drive train 210, which transmits drive to the PF roller 77, is disposed at the opposite side from the conveying motor 201, the LF roller 101 being sandwiched therebetween. The PF roller drive train 210 has an LF output gear 211 attached to the other end of the LF roller 101, an idler gear 212, a pendulum gear unit 213, and the PF input gear 83 mentioned above. The pendulum gear unit 213 has a pendulum arm 214, a sun gear 215, a planetary gear 216, a sun gear 215, and a transmission gear 217 installed coaxially with the sun gear 215 through the intermediary of a one-way clutch. The one-way clutch becomes capable of transmitting drive to the transmission gear 217 when the sun gear 215 rotates clockwise.

In the aforesaid construction, when the LF roller 101 rotates in the forward direction (rotates in the CW direction in the drawing), the drive is transmitted to the sun gear 215 through the intermediary of the LF output gear 211 and the idler gear 212. This causes the sun gear 215 and the pendulum arm 214 to rotate in the CW direction, and the planetary gear 216 to rotate in the CCW direction. The pendulum arm 214 rotates in the CW direction and stops when it comes in contact with a stopper (not shown). The drive is transmitted to the transmission gear 217 by the one-way clutch, causing the PF input gear 83 to rotate in the CCW direction. When the LF roller 101 is rotated in the reverse direction (rotated in the CCW direction in the drawing) from the aforesaid state, the sun gear 215 and the pendulum arm 214 turn in the CCW direction, and the pendulum arm 214 is stopped by a stopper (not shown) at a position where the planetary gear 216 meshes with the PF input gear 83. Then, the PF input gear 83 is rotated in the CW direction by the planetary gear 216. At this time, the transmission gear 217 is rotated in the CW direction by the PF input gear 83, being allowed to rotate because the drive from the sun gear 215 is not transmitted due to the action of the one-way clutch. More specifically, a delay mechanism is provided, whereby the PF input gear 83 stops once when the rotation of the LF roller 101 switches from the forward direction to the reverse direction, and then resumes the rotation when the LF roller 101 rotates by a predetermined amount.

Meanwhile, when the rotational direction of the LF roller 101 switches from the reverse to the forward, the drive is immediately transmitted to the PF input gear 83 with substantially no time delay. The aforesaid predetermined amount depends on the rotational angle of the pendulum arm 214 determined by the stopper of the pendulum arm 214. The predetermined amount in the present embodiment is set such that the drive is transmitted to the PF input gear 83 when the LF roller 101 rotates by 130 degrees (11 mm in terms of the conveyance length of the sheet).

As described above, the first pair of rollers 77 and 86 and the second pair of rollers 101 and 105 are preferably driven by the same conveying motor 201. This makes it possible to restrain an increase in the manufacturing cost and an increase in the size of the apparatus.

Operation from the Start of Feeding to the End of Discharging

A description will now be given of the operation from the start of feeding a sheet to the end of discharging the sheet. FIG. 16 to FIG. 20 are sectional views of the conveying apparatus, which illustrate the positions and states of the sheet observed from the start of the sheet feeding to the end of the sheet discharging. In this example, the speed ratios of the sheet conveyed by the feeding roller 51, the PF roller 77, the LF roller 101, and the discharging roller 106 are set as shown below.

Specifically, when the LF roller 101 rotates in the forward direction, the speed ratio is set to "the feeding roller:the PF roller:the LF roller:the discharging roller=0.6:0.6:1:1." When the LF roller 101 rotates in the reverse direction, the speed ratio is set to "the PF roller:the LF roller:the discharging roller=1:1:1."

First, the feeding roller 51, the PF roller 77, and the LF roller 101 rotate in the forward direction to start feeding the sheet. Then, an uppermost one sheet S is separated from the bundle of sheets, which has been set on the sheet stacking portion 11 with the front surfaces of the sheets (i.e., the image recording surface or image reading surface) facing downward, by the actions of the feeding roller 51 and the slope 61. The separated sheet S is conveyed by the feeding roller 51 and passes the guide surface of the double-side discharging flapper 114 to enter the reversal conveying path. Then, the sheet S reaches the nipping portions (the portions that sandwiches the sheet) of the PF roller 77 and the PF pinch roller 86, and the sheet S is further conveyed to the downstream by the PF roller 77 (refer to FIG. 16). When the sheet S is conveyed by a predetermined amount from the nipping portions of the PF roller 77 and the PF pinch roller 86, the drive of the feeding roller 51 is cut off and the feeding roller 51 stops.

Subsequently, the sheet S is conveyed to the downstream of the reversal conveying path by the PF roller 77 and the PF pinch roller 86, and a sheet detector (not shown) detects the leading end of the sheet. Then, the PF roller 77 and the LF roller 101 are stopped at a position where the sheet has been conveyed by a predetermined amount from the position where the leading end of the sheet was detected. The predetermined amount is preferably changeable according to the type of sheet, such as plain paper or photo paper. In the present embodiment, the predetermined amount has been set such that the PF roller 77 is stopped at a position where the nipping portion of the LF roller 101 has been passed 4 mm in the case of photo paper (refer to FIG. 17). Subsequently, when the LF roller 101 starts to rotate in the reverse direction, the delay mechanism returns the leading end of the sheet S to the nipping portion of the LF roller 101 while the PF roller 77 remains at rest, as described above. Since the PF roller remains at rest, the sheet S placed between the PF roller 77 and the LF roller 101 develops a loop, i.e., a warp, equivalent to 4 mm (refer to FIG. 18). Then, when the LF roller 101 continues to rotate in the reverse direction, the PF roller 77 starts to rotate in the forward direction, adding to the amount of loop generated in the sheet S. This causes the sheet S to touch the outer guide 75 and the PF pinch roller holder 87, and the LF roller 101 stops when the loop can no longer grows larger (the position where the sheet S sticks to the wall surface on the outer peripheral side of a curved path of the conveying path) (refer to FIG. 19). In the present embodiment, the amount of the loop of the sheet S when the LF roller 101 stops is 6 mm. Thus, the leading end of the sheet S is firmly pressed against the nipping portions of the LF roller 101 and the pinch roller 105 while conveying the sheet S by the PF roller 77 and the PF pinch roller 86. This aligns the leading end of the sheet S along the nipping portions, thus correcting the skew of the sheet S. The size of the loop of the sheet S after the skew of the leading end of the sheet S is corrected differs at the right and the left of the sheet S, meaning that the sheet S is warped. In the embodiment described above, the leading end of the sheet S has been pressed against the LF roller 101 and the pinch roller 105, which are rotating in the opposite direction from those of the first pair of rollers 77 and 86. If possible, however, the leading end of the sheet S may be pressed against the LF roller 101 and the pinch roller 105, which are at rest.

Subsequently, the LF roller 101 is rotated in the forward direction to convey the sheet S to an image forming position. At this time, no tension is being applied to the sheet S between the LF roller 101 and the PF roller 77 due to the loop of the sheet S. Hence, the leading end of the sheet S is conveyed at the conveying speed (circumferential velocity) of the LF roller 101, and the middle part or the rear part of the sheet S is conveyed at the conveying speed of the PF roller 77 (circumferential velocity). In this case, if the sheet S is conveyed 15 mm by the LF roller 101, then the loop (6 mm) of the sheet S is eliminated due to the difference in speed between the LF roller 101 and the PF roller 77. The distance from the LF roller 101 to the position of the image forming portion 17, i.e., the image forming start position, has been set to 25 mm. When the sheet S is conveyed to the image forming start position after the loop is eliminated, a tension acts between the LF roller 101 and the PF roller 77, causing the PF roller 77 to be forcibly rotated at a speed of the LF roller 101 (higher speed than the previous speed) due to a frictional force against the sheet S. Thus, setting the circumferential speed of the second pair of rollers 101 and 105 to be higher than the circumferential speed of the first pair of rollers 77 and 86 causes the tension to be applied to the sheet S between the first pair of rollers and the second pair of rollers until the leading end of the sheet S having the skew thereof corrected is conveyed to a predetermined position. Thus, the PF roller 77 is driven by the sheet. The conveyance resistance from the sheet S applied to the PF roller 77 becomes lower or zero. This in turn causes the contact force between the PF roller 77 and the PF pinch roller 86 to decrease to the load of the precompression spring 90. If the sheet S is further conveyed, then the tension of the sheet S exceeds the load of the precompression spring 90. Hence, the PF arm 78 turns counterclockwise, moving the PF roller 77 and the PF pinch roller 86 apart from each other. This clears the warp of the sheet S, which has been developed between the first pair of rollers 77 and 86 and the second pair of rollers 101 and 105 (refer to FIG. 20).

Preferably, the PF roller 77, which is swingably supported, is disposed on the inner peripheral side of the curved path of the conveying path, and the PF pinch roller 86 is disposed on the outer peripheral side of the curved path. With this arrangement, the sheet with skew thereof corrected develops a force to follow the guide by the inner peripheral side of the curved path, making it easy for the PF arm 78, which supports the PF roller 77, to swing so as to move the PF roller 77 and the PF pinch roller 86 away from each other.

In the present example, the first pair of rollers 77 and 86 and the second pair of rollers 101 and 105 are preferably controlled so as to correct the warp of the sheet S before the leading end of the sheet reaches the image forming portion 17. The sheet S is conveyed along the inner guide of the conveying path. The sheet S conveyed to the image forming position is conveyed further to the downstream by the LF roller 101 and the discharging roller 106, and an image is formed by the image forming portion 17. Upon completion of the formation of the image, the sheet S is discharged by the discharging roller 106.

The series of operations described above clears the warp of the sheet S caused by the correction of the skew, so that another skew of the sheet S can be restrained when the sheet S is conveyed by the LF roller 101 thereafter. In the recording apparatus equipped with the aforesaid conveying apparatus is capable of conveying a sheet with high accuracy, thus permitting highly accurate formation of an image. The circumferential speeds of the first pair of rollers 77 and 86 and the second pair of rollers 101 and 105 described above can be controlled by the control portion B1, which will be discussed later.

Figure 21:
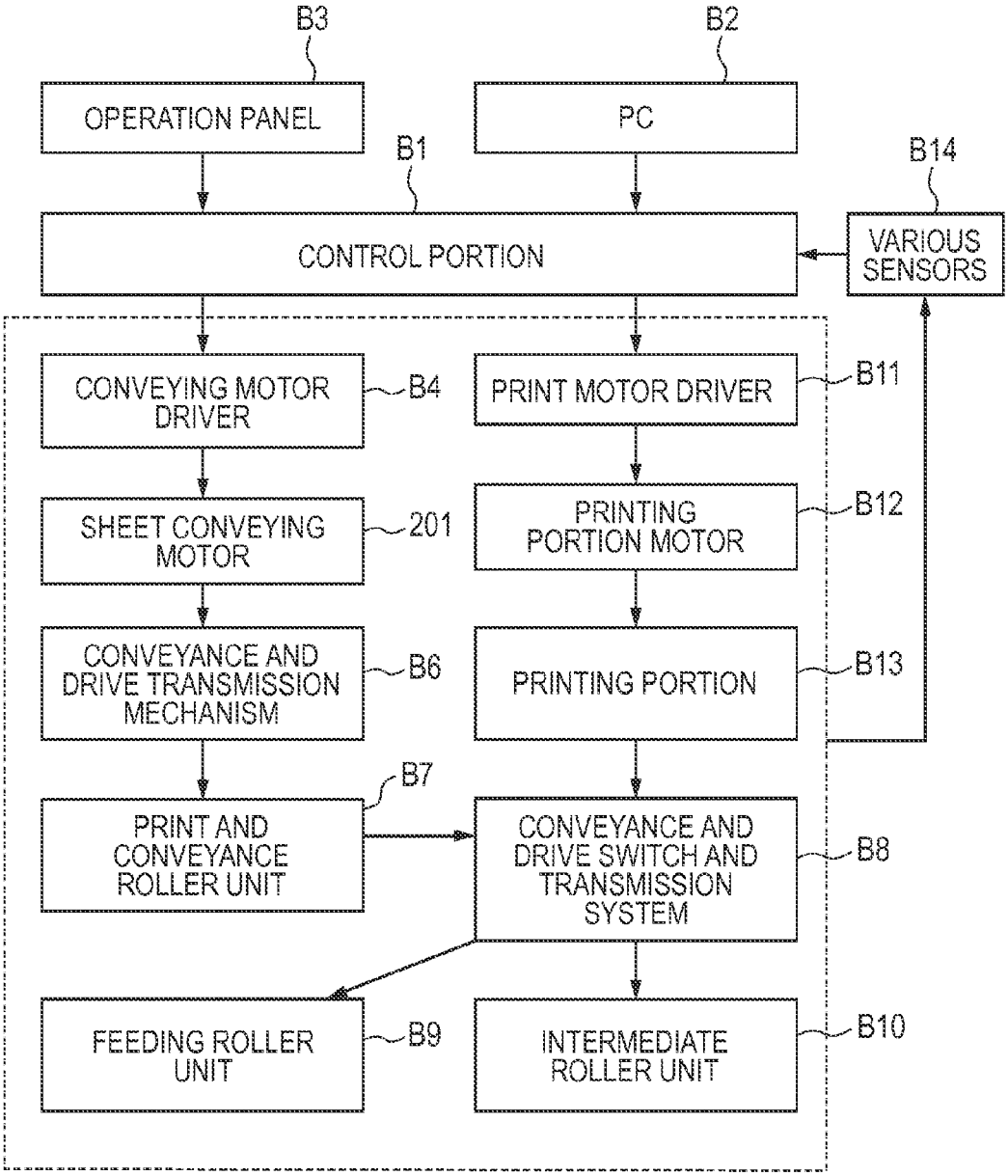
FIG. 21 is a block diagram schematically illustrating a control apparatus that controls a conveying apparatus.

FIG. 21 is a block diagram schematically illustrating the control of an image forming apparatus provided with the conveying apparatus and the image forming portion 17 described above. In this case, the block diagram of an ink jet printer is given as an example of the image forming apparatus. A personal computer B2 and an operation panel B3 are connected to the control portion B1 through the intermediary of an interface of the control portion B1. Upon receipt of a printing instruction, the control portion B1 issues a command to supply electric power to the conveying motor 201, which is connected to a conveyance and drive transmission mechanism B6, through the intermediary of a driver B4 connected to the conveying motor 201. The printing instruction is issued from the personal computer B2 or the operation panel B3, or issued by a timer inside the control portion B1. Concurrently, the control portion B1 issues a command to supply electric power also to a printing portion motor B12, which is connected to a printing portion B13, through the intermediary of a print motor driver B11. Further, the printing portion B13 is operated to switch the drive of a conveyance and drive switch and transmission system B8. Further, a print and conveyance roller unit B7 and a feeding roller unit B9 to which the drive has been transmitted from the conveyance motor 201 through the intermediary of the conveyance and drive transmission mechanism B6 conveys the sheet (recording sheet) S for printing (image forming) and also transmits a rotational driving force to the conveyance and drive switch and transmission system B8. The conveyance and drive switch and transmission system B8 switches between transmission or no transmission of drive and also switches the rotational direction on the driving force, which has been transmitted from the print and conveyance roller unit B7 and the feeding roller unit B9, by the operation of the printing portion B13 and then transmits the driving force to the feeding roller unit B9 and an intermediate roller unit B10. The rotational states and the load conditions of the motors 201 and B12, and the conveyance state of the sheet are detected by various sensors B14 provided at various places of the image forming apparatus, and the detection results are sent in the form of electrical signals to the control portion B1. Based on the instructions and the information on the sensors, the control portion B1 controls the motors 201 and B12 to form an image on the sheet. The intermediate roller unit B10 is a unit that includes the aforesaid first pair of rollers 77 and 86, and the print and conveyance roller unit B7 is a unit that includes the aforesaid second pair of rollers 101 and 105.

The embodiment described above can be applied to a conveying apparatus in an image forming apparatus, such as a printer, a facsimile, a copying machine, or scanner regardless of their types or operating systems, as long as the conveying apparatus is adapted to convey one sheet at a time from the sheet stacking portion 11, the sheet being a sheet-type recording medium or a document. In the case where the image forming portion 17 is constituted of a recording portion, the recording portion may take various recording methods, as long as an image is recorded on a sheet on the basis of the information on the image. The recording portion may use, for example, an ink jet recording apparatus adapted to carry out recording by jetting inks to a sheet from discharge ports of a recording head, or a laser beam type, a thermal transfer type, a thermal type, or a wire dot type recording apparatus. The recording portion may be either a serial type adapted to carry out recording by a recording head mounted on a carriage that reciprocates, or a line type adapted to carry out recording merely by vertical scanning (conveying) of a recording medium by using a recording head that extends in the width direction of the recording medium. Further, the present invention can be applied in the same manner to an image forming apparatus having a recording portion or a reading portion and also to an image forming apparatus constituted of a single device or a plurality of devices combined into one unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179607, filed Aug. 19, 2011, which is hereby incorporated by reference herein in its entirety.

What is claimed is:

1. A conveying apparatus which conveys a sheet along a conveying path, the conveying apparatus comprising:

a first pair of rollers which has a drive roller and a pinch roller driven by the drive roller and which conveys the sheet in a conveying direction while sandwiching the sheet;

a second pair of rollers which is provided on a downstream position in the conveying direction in relation to the first pair of rollers and which conveys the sheet while sandwiching the sheet; and an arm member which supports the drive roller and which is constructed to be swingable such that a force for pressing the drive roller against the pinch roller increases as a conveyance resistance of the sheet increases, whereas the force for pressing the drive roller against the pinch roller decreases in the case of being driven by the sheet that is moving, wherein the first pair of rollers and the second pair of rollers are driven such that a leading end of the sheet sandwiched by the first pair of rollers is pressed against the second pair of rollers which is rotating in a direction opposite from that of the first pair of rollers or at rest thereby to correct a skew of the sheet and such that a conveying speed of the second pair of rollers is higher than the conveying speed of the drive roller so as to cause the drive roller to be driven by the sheet in the case where the sheet having the skew corrected is conveyed by the second pair of rollers.

2. The conveying apparatus according to claim 1, wherein the swing supporting point of the arm member is disposed on an upstream position in the conveying direction in relation to the drive roller.

3. The conveying apparatus according to claim 1, wherein the conveying path has a curved path, which is curved between the first pair of rollers and the second pair of rollers, the drive roller is disposed on an inner peripheral side of the curved path, and the pinch roller is disposed on an outer peripheral side of the curved path.

4. The conveying apparatus according to claim 1, wherein the first pair of rollers and the second pair of rollers are driven by the same drive source.

5. The conveying apparatus according to claim 1, wherein the drive roller is driven by the sheet until the leading end of the sheet is conveyed to a predetermined position.

6. The conveying apparatus according to claim 1, comprising:

a gear, which rotates about an axis common to a swing center axis of the arm member and receives drive from a drive source through the intermediary of a clutch; and transmitting means, which transmits the rotation of the gear such that the drive roller conveys the sheet in the conveying direction in the case where the gear rotates in the same direction as the direction in which the arm member swings to press the drive roller against the pinch roller, wherein the rotational force of the gear acts on the arm member as torque, which causes the arm member to turn to rotate the arm member in a direction for pressing the drive roller against the pinch roller, by conveyance resistance of the sheet.

7. The conveying apparatus according to claim 6, wherein the clutch does not transmit the drive from the drive source in the case where the drive roller is driven by the sheet.

8. An image forming apparatus comprising:

the conveying apparatus according to claim 1; and an image forming portion, which is provided on a downstream position in the conveying direction of the sheet in relation to the second pair of rollers of the conveying apparatus and which forms an image on the sheet.

9. The image forming apparatus according to claim 8, wherein the drive roller is driven by the sheet until the leading end of the sheet reaches the position of the image forming portion.

10. A conveying apparatus comprising:

a first driving roller which conveys a sheet in a conveying direction;

a first pinch roller biased to the first driving roller to pinch the sheet with the first driving roller and to convey the sheet;

a support member which supports the first driving roller, the support member moving the first driving roller to a first position where the first driving roller is in contact with the first pinch roller and to a second position where the first driving roller is separated from the first pinch roller; and a second driving roller which is provided on a downstream position in the conveying direction in relation to the first driving roller and which conveys the sheet, a conveying speed of the second driving roller being faster than a conveying speed of the first driving roller;

wherein after the second driving roller starts to convey the sheet, the support member moves the first driving roller from the first position to the second position if a tension of the sheet between the first driving roller and the second driving roller exceeds a threshold value.

11. A conveying apparatus according to claim 10, wherein a space is formed between the first driving roller and the first pinch roller after the second driving roller starts to convey the sheet, and before the space is formed, a leading edge of the sheet conveyed by the first driving roller abuts the second driving roller to correct a skew.

12. A conveying apparatus according to claim 10, wherein the first driving roller is movably supported, and the sheet conveyed by the second driving roller moves the first driving roller to form a space between the first driving roller and the first pinch roller.

13. An image forming apparatus comprising:

a first driving roller which conveys a sheet in a conveying direction;

a first pinch roller biased to the first driving roller to pinch the sheet with the first driving roller and to convey the sheet;

a support member which supports the first driving roller, the support member moving the first driving roller to a first position where the first driving roller is in contact with the first pinch roller and to a second position where the first driving roller is separated from the first pinch roller; and a second driving roller which is provided on a downstream position in the conveying direction in relation to the first driving roller and which conveys the sheet, a conveying speed of the second driving roller being faster than a conveying speed of the first driving roller, wherein after the second driving roller starts to convey the sheet, the support member moves the first driving roller from the first position to the second position if a tension of the sheet between the first driving roller and the second driving roller exceeds a threshold value; and an image forming portion, which is provided on a downstream position in the conveying direction in relation to the second driving roller and which forms an image on the sheet.

* * * * *